US012546044B2

(12) United States Patent
Chong et al.

(10) Patent No.: US 12,546,044 B2
(45) Date of Patent: Feb. 10, 2026

(54) LAUNDRY MACHINE WITH SMART DISPENSER AND METHOD FOR OPERATION

(71) Applicant: Haier US Appliance Solutions, Inc., Wilmington, DE (US)

(72) Inventors: Jinmo Chong, Seoul (KR); MyungGeon Chung, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 168 days.

(21) Appl. No.: 18/353,672

(22) Filed: Jul. 17, 2023

(65) Prior Publication Data

US 2025/0027248 A1 Jan. 23, 2025

(51) Int. Cl.

| | |
|---|---|
| ***D06F 33/37*** | (2020.01) |
| ***D06F 23/04*** | (2006.01) |
| *D06F 103/22* | (2020.01) |

(52) U.S. Cl.
CPC ..... *D06F 33/37* (2020.02); *D06F 23/04* (2013.01); *D06F 2103/22* (2020.02)

(58) Field of Classification Search
None
See application file for complete search history.

(56) References Cited

U.S. PATENT DOCUMENTS

| | | | | |
|---|---|---|---|---|
| 11,268,227 | B2 | 3/2022 | Kim et al. | |
| 11,299,838 | B2 | 4/2022 | Hwang et al. | |
| 2018/0080164 | A1* | 3/2018 | Hoppe | D06F 35/006 |
| 2019/0010647 | A1* | 1/2019 | Aurora | D06F 34/30 |

FOREIGN PATENT DOCUMENTS

| | | | |
|---|---|---|---|
| CN | 110093750 | A | 8/2019 |
| CN | 110735284 | A | 1/2020 |
| KR | 102345349 | B1 | 12/2021 |

OTHER PUBLICATIONS

CN 116103892 A machine translation, A Door Main Body, Door Assembly, Washing Machine and Washing Machine Using Method, He (Year: 2023).*

* cited by examiner

*Primary Examiner* — Cristi J Tate-Sims
(74) *Attorney, Agent, or Firm* — Dority & Manning, P.A.

(57) ABSTRACT

A laundry machine appliance including an imaging device configured to view a wash chamber, and a method for operation, are provided. The method includes operating the imaging device toward the wash chamber, and determining, via the imaging device, whether a detergent is provided to the wash chamber. When determined that the detergent is provided, via the user, to the wash chamber, the method transmits a communications signal to a user to determine whether a user wants detergent to be supplied, via the dispenser, to the wash basket. The method dispenses, via a dispenser, detergent to the wash chamber, when the user requests dispensation of detergent by the dispenser. When determined that the detergent is not provided, via the user, to the wash chamber, the method obtains a user control signal corresponding to a command for starting a wash cycle and dispensing, via the dispenser, detergent to the wash chamber.

20 Claims, 5 Drawing Sheets

LAUNDRY MACHINE WITH SMART DISPENSER AND METHOD FOR OPERATION

FIELD OF THE INVENTION

The present subject matter relates generally to laundry machine apparatuses, and more particularly, smart dispensers and methods for operation thereof.

BACKGROUND OF THE INVENTION

Conventional laundry machines, such as washing machines, may include smart detergent dispensers configured to automatically dispense detergent for a wash cycle. However, conventional smart dispensers may dispense detergent without regard for whether any other detergent was manually provided by a user. Accordingly, known washing machines may have an inefficiency resulting from dispensing detergent more than once.

Accordingly, a laundry machine including features addressing the aforementioned issues would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a laundry machine appliance, including a cabinet forming an interior volume, a tub positioned within the interior volume, a wash basket rotatably mounted within the tub, the wash basket forming a wash chamber extending along a vertical direction. A dispenser is configured to receive a volume of detergent and dispense a portion thereof to the wash chamber. An imaging device is positioned to obtain images at the wash chamber. A controller is configured to store instructions that, when executed, perform operations, the operations including operating the imaging device toward the wash chamber; determining, via the imaging device, whether a detergent is provided to the wash chamber; when determined that the detergent is provided, via the user, to the wash chamber, transmitting a communications signal to a user to determine whether a user wants detergent to be supplied, via the dispenser, to the wash basket; dispensing, via the dispenser, detergent to the wash chamber, when the user requests dispensation of detergent by the dispenser; and when determined that the detergent is not provided, via the user, to the wash chamber, obtaining a user control signal corresponding to a command for starting a wash cycle and dispensing, via the dispenser, detergent to the wash chamber.

An aspect of the present disclosure is directed to a method for operating a washing machine appliance. The method includes operating an imaging device toward a wash chamber, and determining, via the imaging device, whether a detergent is provided to the wash chamber. When determined that the detergent is provided, via the user, to the wash chamber, the method transmits a communications signal to a user to determine whether a user wants detergent to be supplied, via the dispenser, to the wash basket. The method dispenses, via a dispenser, detergent to the wash chamber, when the user requests dispensation of detergent by the dispenser. When determined that the detergent is not provided, via the user, to the wash chamber, the method obtains a user control signal corresponding to a command for starting a wash cycle and dispensing, via the dispenser, detergent to the wash chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
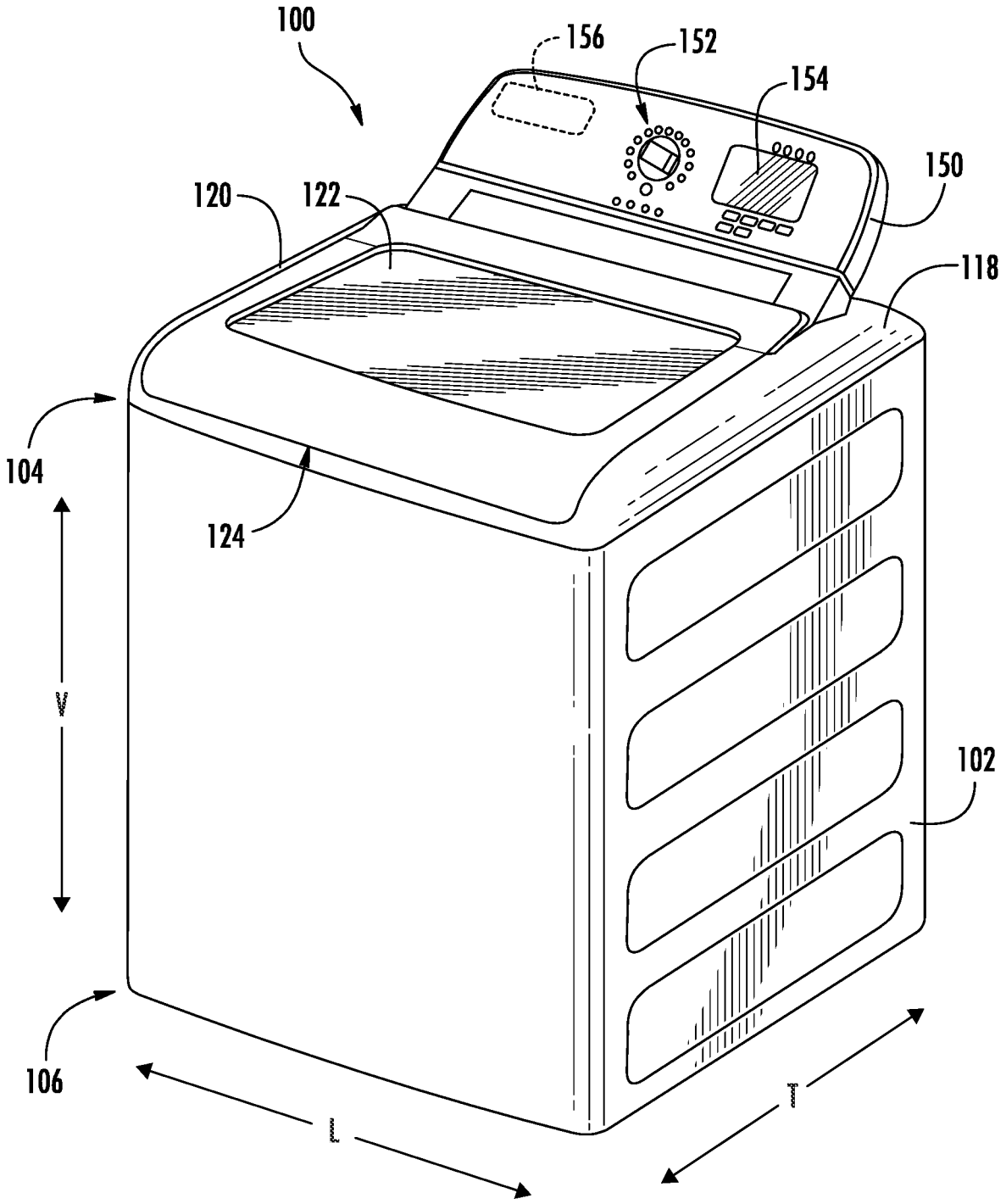
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
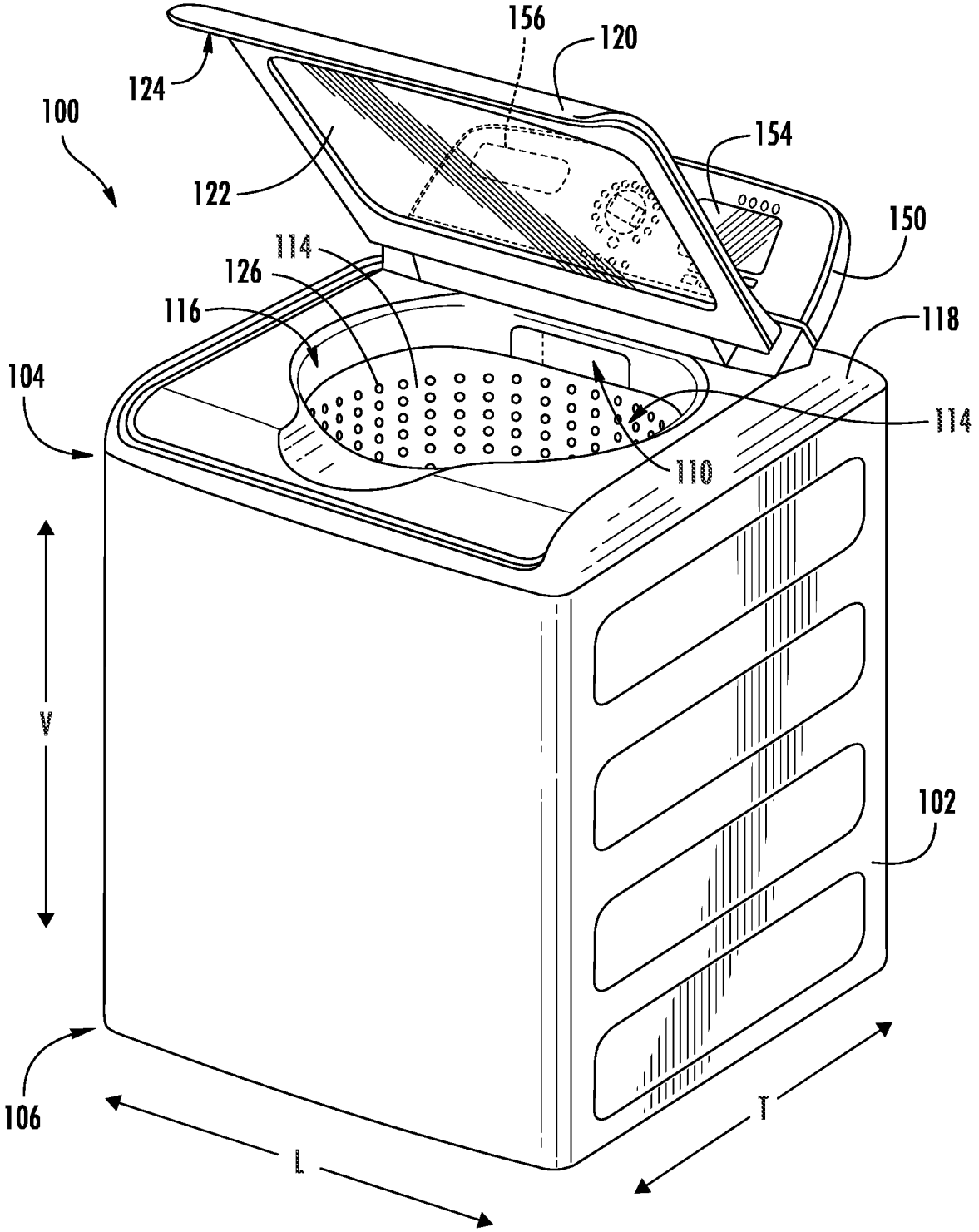
FIG. 2 provides a perspective view of the exemplary laundry machine appliance of FIG. 1 with the lid in an open position.
Figure 3:
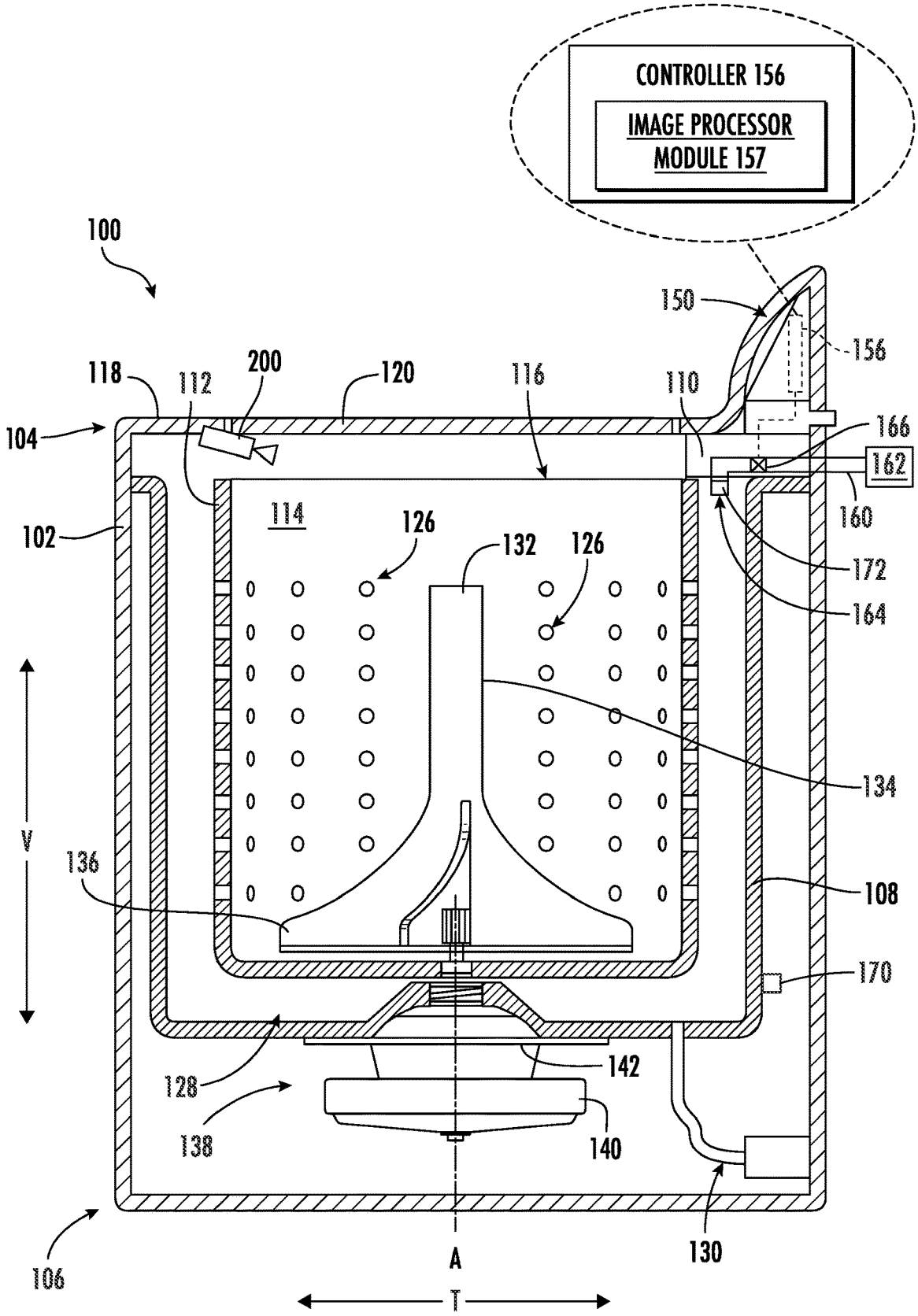
FIG. 3 provides a cut-away side view of the exemplary laundry machine appliance of FIG. 1.
Figure 4:
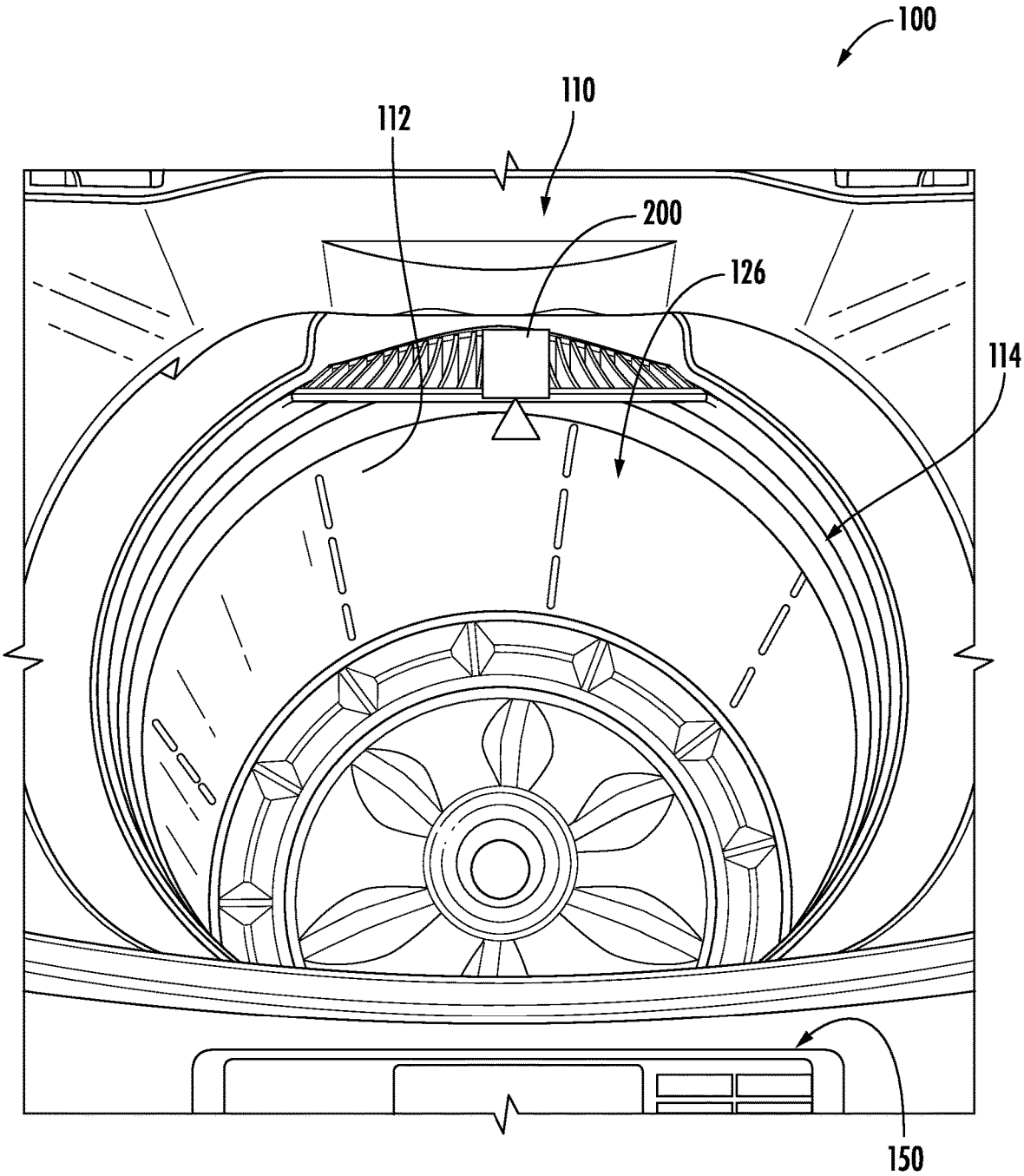
FIG. 4 provides a perspective view into a wash chamber of the exemplary laundry machine appliance of FIG. 1.

FIGS. 1 through 3 illustrate an exemplary embodiment of a vertical axis laundry machine appliance or washing machine 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. In particular embodiments, the primary dispense 110 forms a smart dispenser configured to receive a volume of detergent and to automatically dispense a portion thereof for each laundry load. The term "wash fluid" refers to a liquid used for washing and/or rinsing articles during an operating cycle and may include any combination of water, detergent, fabric softener, bleach, and other wash additives or treatments.

In addition, laundry machine appliance 100 includes a drum or wash basket 112 that is positioned within tub 108 and generally defines a wash chamber 114 including an opening 116 for receipt of articles for washing. More specifically, wash basket 112 may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 defines an opening (FIG. 2) that coincides with opening 116 of wash basket 112 to permit a user access to wash basket 112. Laundry machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. Perforations 126 extend through the wash basket 112.

Wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

In some embodiments, an impeller or agitator 132 (FIG. 3), such as a vane agitator, impeller, auger, oscillatory basket mechanism, or some combination thereof is configured to impart an oscillatory motion to articles and liquid in wash basket 112. More specifically, agitator 132 may include a shaft 134 extending along the vertical axis V and an oscillatory member 136 extending from the shaft 134. The agitator 132 may extend into wash basket and assists agitation of articles disposed within wash basket 112 during operation of laundry machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1-3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. Laundry appliance 100 may include a flow meter 172. Flow meter 172 may be connected to water supply conduit 160 to measure an amount of water added to tub 108. Flow meter 172 may send the detected water flow amount to controller 156. In addition, laundry machine appliance 100 may include one or more pressure sensors 170 for detecting the amount of water and or clothes within tub 108. For example, pressure sensor 170 may be operably coupled to a side of tub 108 for detecting the weight of tub 108. Additionally or alternatively, pressure sensor 170 may detect and/or calculate a pressure of water within tub 108.

The appliance 100 includes an imaging device 200 positioned to view, capture, or record into the wash chamber 114. The imaging device 200 may be positioned at the front, top of a top load washing machine appliance. The imaging device 200 may be positioned at any desired angular position relative to the wash basket 112. For instance, the imaging device 200 may be positioned between 45 degrees and 90 degrees. In various embodiments, the imaging device 200 is configured as a camera or other device configured to observe or detect liquid or particulates poured into the wash chamber 114. The imaging device 200 may furthermore be positioned to detect when water is being poured into the wash chamber 114.

The controller 156 includes an image processor module including an image classification model configured to detect whether detergent is poured into the wash chamber 114, or has been poured into the wash chamber 114. For instance, the imaging device 200 may be positioned to detect whether liquid or particulates (e.g., liquid or solid detergent) is poured across a plane (e.g., poured across opening 116) into the wash chamber 114.

Additionally, or alternatively, the imaging device 200 is positioned to detect whether liquid or particulates has landed onto laundry articles in the wash chamber 114. For instance, the imaging device 200 and image processor module may be configured to detect when laundry articles have been inserted into the wash chamber 114, and furthermore determine whether liquid or particulates has been poured into the wash chamber 114 (e.g., after insertion of laundry articles into the wash chamber 114).

Figure 5:
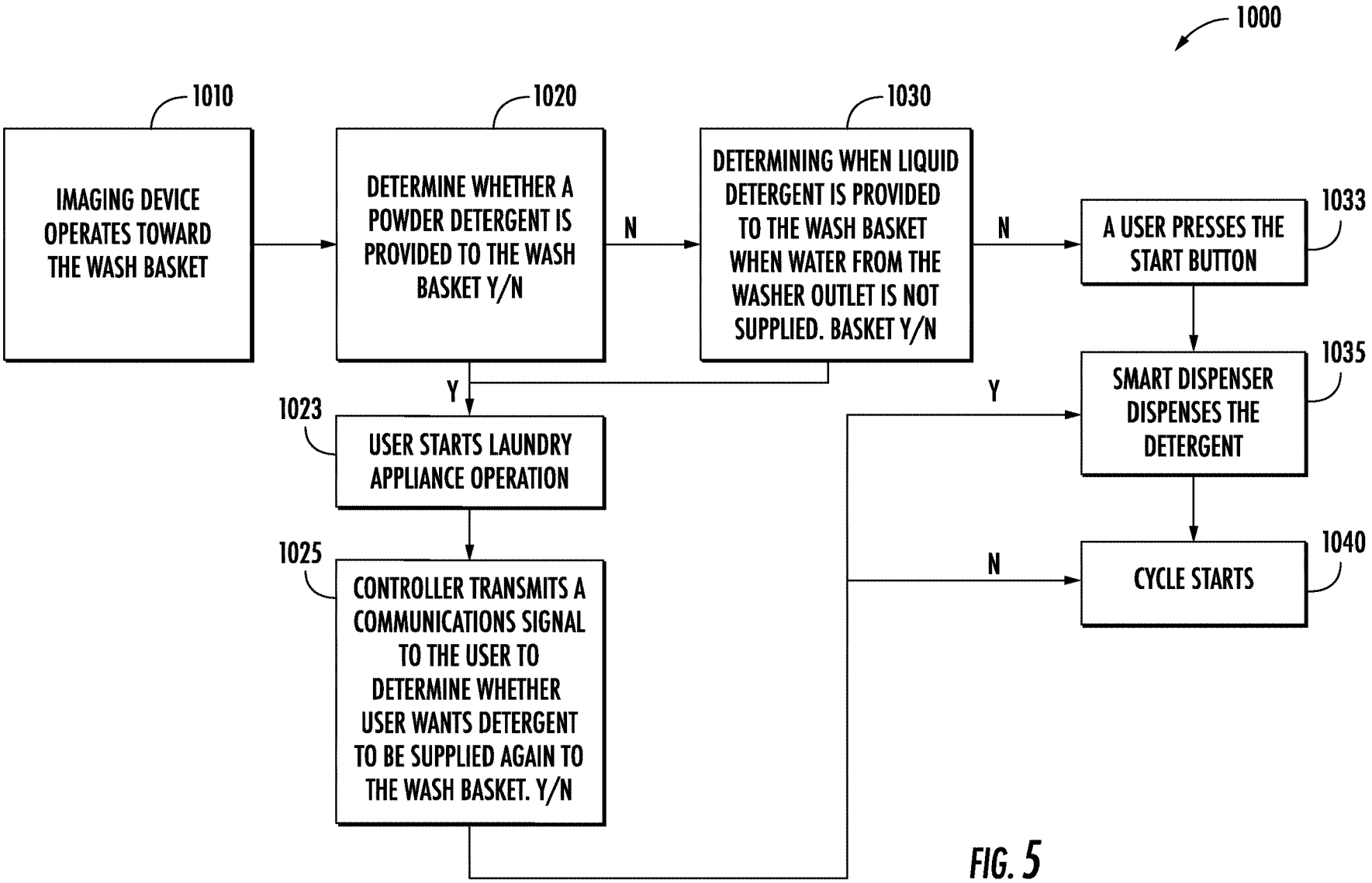
FIG. 5 provides an exemplary flowchart outlining steps of a method for operating a laundry appliance in accordance with aspects of the present disclosure.

Referring now to FIG. 5, an exemplary flowchart outlining steps of a method for operating a laundry appliance is provided (hereinafter, "method 1000"). Steps of the method 1000 may be stored as instructions at the controller 156 that, when executed by controller 156, performs operations, such as may be included in one or more steps of the method 1000.

Method 1000 includes at 1010 operating an imaging device toward a wash basket, such as described above in regard to imaging device 200 at wash basket 112. Method 1000 includes at 1020 determining whether a powder detergent is provided to the wash basket, such as via the imaging device 200 such as described above.

When the controller 156 determines that a powder detergent has not been provided, method 1000 includes at 1030 determining whether a liquid detergent is provided to the wash basket, such as via the imaging device 200 such as described above. In particular embodiments, method 1000 at 1030 include determining when liquid detergent is provided to the wash basket when water from the washer outlet (e.g., from the discharge nozzle 164) is not supplied.

Whether method 1000 determines liquid detergent was manually provided to the wash basket by the user, method 1000 includes at 1023 or 1033 obtaining a user control signal corresponding to a command for starting laundry appliance operation (e.g., selection or start of a wash cycle).

When the controller 156 determines that a powder detergent has been provided, method 1000 includes at 1025 transmitting a communications signal to a user to determine whether the user wants detergent to be supplied again to the wash basket. The communications signal may be transmitted from the controller 156 to the control panel 150 or a remote user interface (e.g., a computing device, such as a smartphone, a tablet, a laptop, or another appliance) as a visual or audio message to prompt the user whether to have detergent supplied from the primary dispenser 110. In various embodiments, the communications signal is transmitted after the user commands start of laundry machine operation (e.g., method 1000 at 1023).

When the user requests for detergent to be supplied from the primary dispenser to the wash basket, method 1000 includes at 1035 dispensing, from the detergent dispenser (e.g., primary dispenser 110), a quantity of detergent. It should be appreciated that method 1000 at 1035 may include dispensing a predetermined amount of detergent, such as a fixed amount, or a variable amount based on the wash cycle, laundry load, user input, or combinations thereof.

Furthermore, when the controller 156 determines that detergent was not provided by the user, method 1000 includes at 1035 dispensing the detergent to the wash basket via the dispenser (e.g., via a smart dispenser, such as primary dispenser 110). In various embodiments, when the controller 156 determines that detergent was not provided by the user, method 1000 performs step 1035 after the user commands start of the wash cycle (step 1033).

Method 1000 includes at 1040 performing the wash cycle. In some embodiments, step 1040 commences after detergent is dispensed at step 1035. In still some embodiments, step 1040 commences after the user declines to request for detergent to be supplied from the primary dispenser to the wash basket, such as the user declining after receiving the communications signal at 1025. It should be appreciated that embodiments of the method 1000 include receiving, at the controller 156, a user input signal corresponding to request for detergent dispensation or denial for detergent dispensation at step 1025.

Embodiments of the appliance 100 and method 1000 provided herein may mitigate or eliminate accidental provision of detergent more than once for a wash cycle. Embodiments provided herein beneficially result in reduced detergent usage and improved efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry machine appliance, comprising:

a cabinet forming an interior volume;

a tub positioned within the interior volume;

a wash basket rotatably mounted within the tub, the wash basket forming a wash chamber extending along a vertical direction;

a dispenser configured to receive a volume of detergent and dispense a portion thereof to the wash chamber;

an imaging device positioned to obtain images at the wash chamber; and a controller configured to store instructions that, when executed, perform operations, the operations comprising:

operating the imaging device toward the wash chamber;

determining, via the imaging device, whether a detergent is provided to the wash chamber;

when determined that the detergent is provided, via a user, to the wash chamber, transmitting a communications signal to the user to determine whether the user wants detergent to be supplied, via the dispenser, to the wash basket chamber;

dispensing, via the dispenser, detergent to the wash chamber, when the user requests dispensation of detergent by the dispenser; and when determined that the detergent is not provided, via the user, to the wash chamber, obtaining a user control signal corresponding to a command for starting a wash cycle and dispensing, via the dispenser, detergent to the wash chamber.

2. The laundry machine appliance of claim 1, the operations comprising:

performing the wash cycle after dispensing detergent to the wash chamber.

3. The laundry machine appliance of claim 1, the operations comprising:

receiving, at the controller, a user input signal corresponding to declining detergent dispensation, then performing the wash cycle.

4. The laundry machine appliance of claim 1, the operations comprising:

receiving, at the controller, a user input signal corresponding to request for detergent dispensation, then dispensing, via the dispenser, detergent to the wash chamber.

5. The laundry machine appliance of claim 1, the operations comprising:

obtaining a user control signal corresponding to a command for commencing the wash cycle, then transmitting the communications signal to the user to determine whether the user wants detergent to be the supplied, via the dispenser, to the wash chamber.

6. The laundry machine appliance of claim 1, wherein determining whether the detergent is provided to the wash chamber comprises:

determining, via the imaging device, whether a powder detergent is provided to the wash chamber.

7. The laundry machine appliance of claim 6, the operations comprising:

determining, via the imaging device, whether a liquid detergent is provided to the wash chamber.

8. The laundry machine appliance of claim 7, wherein determining whether the liquid detergent is provided to the wash basket is after determining that the powder detergent was not provided to the wash chamber.

9. The laundry machine appliance of claim 7, wherein determining whether liquid detergent is provided to the wash basket is when water from a washer outlet is not supplied to the wash chamber.

10. The laundry machine appliance of claim 1, wherein the controller comprises an image processor module comprising an image classification model configured to detect whether detergent is poured into the wash chamber.

11. The laundry machine appliance of claim 1, wherein the laundry machine appliance is a top-load washing machine appliance.

12. A method for operating a washing machine appliance comprising an imaging device configured to view to a wash chamber, the method comprising:

operating the imaging device toward the wash chamber;

determining, via the imaging device, whether a detergent is provided to the wash chamber;

when determined that the detergent is provided, via a user, to the wash chamber, transmitting a communications signal to a user to determine whether the user wants detergent to be supplied, via the dispenser, to the wash chamber;

dispensing, via the dispenser, detergent to the wash chamber, when the user requests dispensation of detergent by the dispenser; and when determined that the detergent is not provided, via the user, to the wash chamber, obtaining a user control signal corresponding to a command for starting a wash cycle and dispensing, via the dispenser, detergent to the wash chamber.

13. The method of claim 12, the method comprising:

performing the wash cycle after dispensing detergent to the wash chamber.

14. The method of claim 12, the method comprising:

receiving a user input signal corresponding to declining detergent dispensation, then performing the wash cycle.

15. The method of claim 12, the method comprising:

receiving a user input signal corresponding to request for detergent dispensation, then dispensing, via the dispenser, detergent to the wash chamber.

16. The method of claim 12, the method comprising:

obtaining a user control signal corresponding to a command for commencing the wash cycle, then transmitting the communications signal to the user to determine whether the user wants detergent to be the supplied, via the dispenser, to the wash chamber.

17. The method of claim 12, wherein determining whether the detergent is provided to the wash chamber comprises:

determining, via the imaging device, whether a powder detergent is provided to the wash chamber.

18. The method of claim 17, the method comprising:

determining, via the imaging device, whether a liquid detergent is provided to the wash chamber.

19. The method of claim 18, wherein determining whether the liquid detergent is provided to the wash basket is after determining that the powder detergent was not provided to the wash chamber.

20. The method of claim 18, wherein determining whether liquid detergent is provided to the wash basket is when water from a washer outlet is not supplied to the wash chamber.

* * * * *